US009692171B2

(12) United States Patent
Suzuki et al.

(10) Patent No.: US 9,692,171 B2
(45) Date of Patent: Jun. 27, 2017

(54) WATERPROOF CONNECTOR

(71) Applicant: YAZAKI CORPORATION, Tokyo (JP)

(72) Inventors: Toru Suzuki, Shizuoka (JP); Satoshi Nakai, Shizuoka (JP)

(73) Assignee: YAZAKI CORPORATION, Minato-ku, Tokyo (JP)

( * ) Notice: Subject to any disclaimer, the term of this patent is extended or adjusted under 35 U.S.C. 154(b) by 0 days.

(21) Appl. No.: 15/137,377

(22) Filed: Apr. 25, 2016

(65) Prior Publication Data

US 2016/0240956 A1 Aug. 18, 2016

Related U.S. Application Data

(63) Continuation of application No. PCT/JP2013/079564, filed on Oct. 31, 2013.

(51) Int. Cl.
*H01R 13/52* (2006.01)
*H01R 13/502* (2006.01)
*H01R 103/00* (2006.01)

(52) U.S. Cl.
CPC ..... *H01R 13/5205* (2013.01); *H01R 13/502* (2013.01); *H01R 13/5208* (2013.01); *H01R 2103/00* (2013.01)

(58) Field of Classification Search
CPC ..... H01R 13/5205; H01R 13/502; H01R 2103/00
See application file for complete search history.

(56) References Cited

U.S. PATENT DOCUMENTS 5,064,967 A * 11/1991 Singbartl ..... H02G 3/065 174/549
5,145,402 A * 9/1992 Plyler ..... H01R 13/5219 439/274

(Continued)

FOREIGN PATENT DOCUMENTS

JP 5920577 U 2/1984
JP 9-106854 A 4/1997

(Continued)

OTHER PUBLICATIONS

Communication, dated Jun. 28, 2016, from the Japanese Patent Office in counterpart Japanese application No. 2012-104746.

(Continued)

*Primary Examiner* — Briggitte R Hammond
(74) *Attorney, Agent, or Firm* — Sughrue Mion, PLLC

(57) ABSTRACT

A waterproof connector includes a connector housing. The connector housing includes: a terminal housing part for housing a terminal; a core-wire housing part which is provided continuously to the terminal housing part and houses a core wire part of an electric wire; and a covered end insertion part into which a covered end of the electric wire is inserted. The covered end insertion part is provided with a waterproof partition wall, so that respective interiors of the core-wire housing part and the terminal housing part are kept in a waterproof state. The core-wire housing part is provided, around the core wire part, with a hollow part which allows the core wire part of an end of the electric wire to move freely within the core-wire housing part.

3 Claims, 2 Drawing Sheets

(56) References Cited

U.S. PATENT DOCUMENTS

| | | | | |
|---|---|---|---|---|
| 5,540,450 | A * | 7/1996 | Hayashi | H02G 15/013 174/152 G |
| 5,795,170 | A | 8/1998 | Okabe | |
| 5,882,226 | A * | 3/1999 | Bell | H01R 9/032 439/11 |
| 5,931,699 | A * | 8/1999 | Saito | H01R 13/5208 439/275 |
| 6,325,661 | B1 * | 12/2001 | Tabata | H01R 13/5205 439/459 |
| 6,478,608 | B1 * | 11/2002 | Grant | H01R 13/506 439/456 |
| 7,044,762 | B1 * | 5/2006 | Hong | H01R 13/6275 439/275 |
| 7,044,786 | B2 * | 5/2006 | Nimura | H01R 13/5829 439/459 |
| 7,285,011 | B2 * | 10/2007 | Hardy | H01R 13/506 439/582 |
| 2005/0009394 | A1 * | 1/2005 | Kameyama | H01R 13/5216 439/274 |
| 2012/0094538 | A1 * | 4/2012 | Ikeda | H01R 13/5841 439/625 |
| 2012/0100753 | A1 | 4/2012 | Omae et al. | |

FOREIGN PATENT DOCUMENTS

| | | | |
|---|---|---|---|
| JP | 10-149843 | A | 6/1998 |
| JP | 2000-268908 | A | 9/2000 |
| JP | 2000353568 | A | 12/2000 |
| JP | 2006-196427 | A | 7/2006 |
| JP | 2008-98103 | A | 4/2008 |
| JP | 2010-211935 | A | 9/2010 |
| JP | 2011-119120 | A | 6/2011 |
| JP | 2013-232369 | A | 11/2013 |

OTHER PUBLICATIONS

Notification of Reasons for Refusal of Japanese Patent Application No. 2012-104746 dated Dec. 22, 2015.

International Search Report of PCT/JP2013/079564 dated Feb. 4, 2014.

Communication dated Feb. 21, 2017, from the Japanese Patent Office in counterpart application No. 2012-104746.

Communication dated Oct. 4, 2016, from the Japanese Patent Office in counterpart application No. 2016-011548.

* cited by examiner

WATERPROOF CONNECTOR

CROSS REFERENCE TO RELATED APPLICATIONS

This application is a continuation of International Application No. PCT/JP2013/079564, filed Oct. 31, 2013, the entire contents of which are incorporated herein by reference.

TECHNICAL FIELD

The present invention relates to a waterproof connector where an electric wire end and a terminal connected to the electric wire end are housed in a connector housing in a waterproof state.

BACKGROUND ART

In a connector where an electric wire end and a terminal connected to the electric wire end are housed in a connector housing, there are used a structure for preventing an entry of water transported through a surface of the electric wire.

In JP H09-106854 A (PTL 1), a space inside the connector housing, which is defined between the electric wire end and the inner wall of the connector housing, is filled up with resin to prevent water on the surface of the wire from being transported up to the electric wire end and the terminal connected to the electric wire end.

Additionally, there is also proposed a so-called "mold-type" waterproof connector where an electric wire end and a terminal connected to the electric wire end are integrally molded simultaneously with the molding of a connector housing.

SUMMARY

In the connector which fills up the interior of the connector housing with resin for waterproof or the connector where the electric wire end and the terminal connected to the electric wire end are molded integrally with the connector housing, however, when fitting the connector to a counter connector and if their fitting positions are displaced from each other, a clearance could be produced between the terminal connected to the electric wire end and a terminal on the side of the counter connector or conversely, these terminals could abut on each other when fitting the connector to the counter connector.

Specifically, if filling up the connector with resin for waterproof or molding the electric wire end and terminal integrally with the connector housing, then the electric wire end and the terminal are positioned in their fixed positions, causing a problem that it becomes impossible to absorb a displacement in the fitting position with the counter connector when fitting the connector to the counter connector.

Therefore, an object of the present invention is to provide a connector capable of absorbing a positional displacement with a counter connector while securing reliable waterproofing performance.

A connector according to a first aspect of the present invention includes a connector housing in which a terminal connected to an end of an electric wire and a core wire part of the electric wire connected to the terminal are housed. The connector housing includes a terminal housing part for housing the terminal, a core-wire housing part continuously formed to the terminal housing part to house the core wire part of the electric wire and a covered end insertion part into which a covered end of the electric wire is inserted. The covered end insertion part is provided with a waterproof partition wall which keeps respective interiors of the core-wire housing part and the terminal housing part in a waterproof state. The core-wire housing part is provided, around the core wire part, with a hollow part which allows the core wire part at the end of the electric wire to move freely within the core-wire housing part.

With the constitution mentioned above, even if a displacement is produced in the fitting position when the waterproof connector is fitted to a counter connector to connect the terminal connected to the end of the electric wire to a terminal of the counter connector, the terminal connected to the end of the electric wire can follow the position of the terminal of the counter connector since the hollow part is defined around the core wire part at the end of the electric wire. Accordingly, it is possible to absorb the displacement in the fitting position between the waterproof connector and the counter connector. Additionally, as the covered end insertion part is provided with the waterproof partition wall, the interior of the core-wire housing part is waterproofed certainly. Therefore, the waterproof connector can absorb its positional displacement against the counter connector while securing reliable waterproofing performance.

It is preferable that the terminal includes a counter-terminal connection box which allows a counter terminal to be inserted thereinto and a core-wire connecting terminal plate to which the core wire part of the electric wire is connected.

With the constitution mentioned above, even if a positional displacement is produced between the connector and the counter connecter when the counter terminal of the counter connector is inserted into the counter-terminal connection box of the terminal, the core wire part could follow the movement of the terminal caused by such an insertion of the counter terminal because the core wire part can move freely within the core-wire housing part.

It is preferable that: the terminal housing part is formed with a counter-terminal insertion port; the core-wire housing part is formed with a wire outlet port; and the wire outlet port is closed by a rear wall member.

With the constitution mentioned above, as the wire outlet side is closed by the rear wall member in addition to the waterproof partition wall, more certain waterproof performance is obtained.

DESCRIPTION OF EMBODIMENTS

An embodiment of the present invention will be described with reference to drawings.

Figure 1:
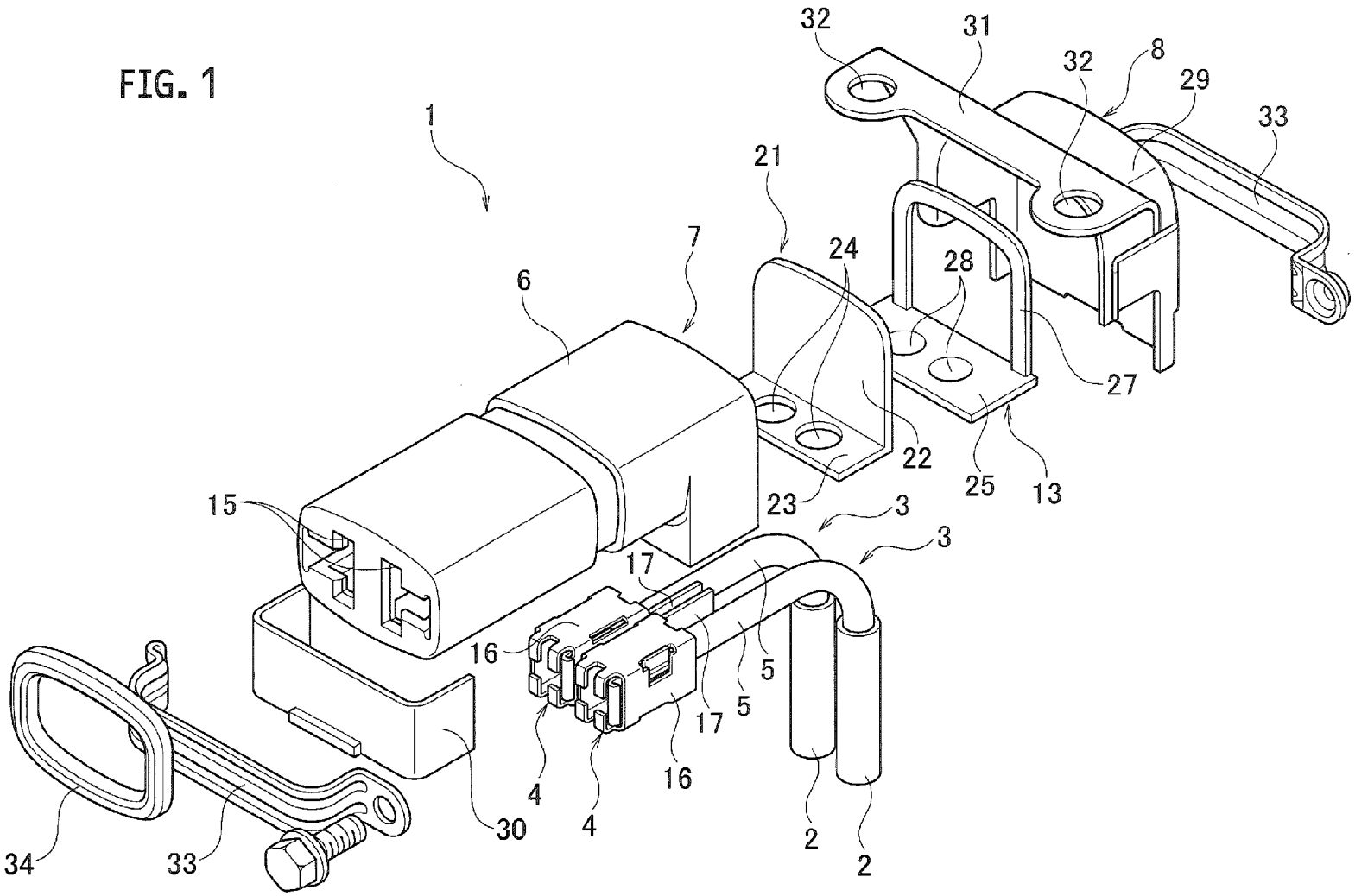
FIG. 1 is an exploded perspective view illustrating a waterproof connector according to an embodiment.
Figure 2:
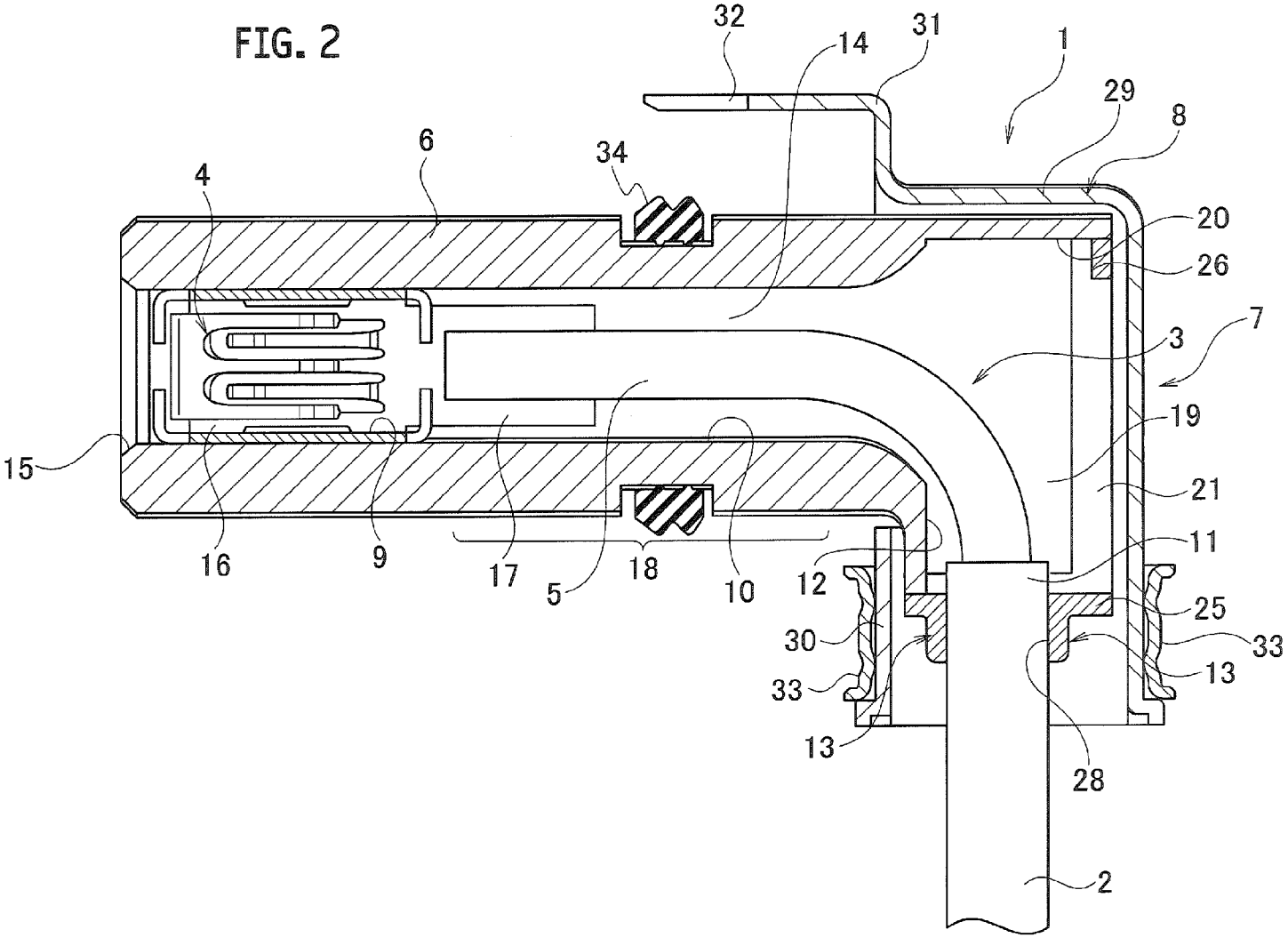
FIG. 2 is a sectional view illustrating the interior of a counter housing of the water connector according to the embodiment.

As illustrated in FIGS. 1 and 2, a waterproof connector 1 according to the embodiment includes a connector housing 6 in which terminals 4 each connected to an end 3 of an electric wire 2 and core wire parts 5 of the electric wires 2 connected to the terminals 4 are housed. On a wire outlet side 7 of the connector housing 6, an outer periphery of a rear end side of the wire outlet side 7 is surrounded by a shield shell 8, thereby shielding the rear end side of the connector housing 6.

The connector housing 6 includes a terminal housing part 9 for housing the terminals 4, a core-wire housing part 10 which is provided continuously to the terminal housing part 9 and in which the core wire parts 5 of the electric wires 2 are housed, and a covered end insertion part 12 into which covered ends 11 of the electric wires 2 are inserted. The covered end insertion part 12 is provided with a waterproof partition wall 13 which keeps respective interiors of the core-wire housing part 10 and the terminal housing part 9 in a waterproof state. In the core-wire housing part 10, a hollow part 14 is provided around the core wire parts 5 of the ends 3 of the electric wires 2 so that the core wire parts 5 can move freely within the core-wire housing part 10.

The terminal housing part 9 is formed in a tubular shape. The terminal housing part 9 is formed, on its leading-end side, with a counter-terminal insertion port 15 into which counter terminals (not illustrated) can be inserted. The core-wire housing part 10 and the covered end insertion part 12 are formed on the rear-end side of the terminal housing part 9. The terminals 4 connected to the ends 3 of the electric wires 2 are accommodated in the terminal housing part 9.

Each of the terminals 4 is formed with a box-shaped counter-terminal connection box 16 into which the counter terminals are inserted for connection, and, on the rear-end side of the counter-terminal connection box 16, a core-wire connecting terminal plate 17 to which an end of the core wire part 5 is welded. The core wire part 5 welded to the core-wire connecting terminal plate 17 is accommodated in the core-wire housing part 10.

The core-wire housing part 10 includes a straight-portion housing area 18 for accommodating the core wire parts 5 in a straight manner, and a curved-portion housing area 19 for accommodating the core wire parts 5 while it is being folded generally perpendicularly. The curved-portion housing area 19 is provided with a wire outlet port 20, and the covered end insertion part 12 which opens downward continuously to the wire outlet port 20. The wire outlet port 20 and the covered end insertion part 12 are closed by a rear wall member 21.

The rear wall member 21 is formed in a nearly-L shape composed of a first closing plate part 22 and a wire insertion plate part 23 formed integrally with the first closing plate part 22. The first closing plate part 22 closes up the rear end side of the curved-portion housing area 19 completely. The wire insertion plate part 23 is formed with first wire insertion holes 24, 24 through which the electric wires 2 are inserted together with the covered ends 11. The waterproof partition wall 13 is assembled to the exterior side of the rear wall member 21.

The waterproof partition wall 13 includes a second closing plate part 25 assembled so as to overlap the exterior side of the wire insertion plate part 23, and a flame part 27 formed so as to stand from the second closing plate part 25 and engaged with an engagement recess 26 of the rear wall member 21. The second closing plate part 25 is formed with second wire insertion holes 28, 28 through which the electric wires 2 are inserted together with their cover parts.

Then, the interiors of the terminal housing part 9 and the core-wire housing part 10 are formed into waterproof structure by the first closing plate part 22 and wire insertion plate part 23 of the rear wall member 21, so that the entry of water transported into the inside through the surfaces of the electric wires 2 is blocked by the waterproof partition wall 13.

In connection, the waterproof partition wall 13 may be molded integrally with the rear wall member 21. Alternatively, the waterproof partition wall 13 may be molded integrally with the rear wall member 21 when the connector housing 6 is molded integrally with the rear wall member 21.

The shield shell 8 on the rear end side of the connector housing 6 is formed by an upper shell 29 covering the top side of the connector housing 6, and an under shell 30 covering the side of the covered end insertion part 12. Provided integrally with the upper shell 29 is a fixing bracket 31 which is fixed to an inverter case (not illustrated). The fixing bracket 31 is provided with bolt insert holes 32, 32. Since the bracket 31 is bolted to the inverter case, the shield shell 8 is fixed to the inverter case, thereby shielding the rear end side of the connector housing 6 partially.

The upper shell 29 and the under shell 30 are formed integrally since they are clamped and fixed by clamping members 33, 33.

A seal member 34 is fitted in a groove **6*a* provided at an intermediate portion of the connector housing 6. The seal member 34 seals between the inverter case and the outer circumference of the connector housing 6**.

When fitting the connector housing 6 in the state illustrated in FIG. 2 to the counter connector on the side of the inverter case, the counter terminals of the counter connector are inserted into and connected to the counter-terminal connection box 16, so that the ends 3 of the electric wires 2 are connected to a circuit body or the like in the inverter case.

If there are produced displacements in the fitting positions against the counter terminals of the counter connector when fitting the waterproof connector 1 to the counter connector on the side of the inverter case, the positions of the counter-terminal connection boxes 16 of the terminals 4 are displaced (moved) in the terminal housing part 9. Following the movement of the terminals 4, the core wire parts 5 move in the hollow part 14 around the core wire parts 5.

Thus, even if displacements are produced in the fitting position, the terminals 4 connected to the ends of the electric wires 2 can be deviated in accordance with the positions of the counter terminals of the counter connector since the hollow part 14 is defined around the core wire parts 5 at the ends of the electric wires 2. Consequently, it is possible to absorb a displacement in the fitting position between the waterproof connector and the counter connector. Then, as the covered end insertion part 12 is provided with the waterproof partition wall 13, the interior of the core-wire housing part 10 is waterproofed certainly.

Accordingly, it is possible to absorb the positional displacement against the counter connector while securing reliable waterproofing performance.

What is claimed is:

1. A waterproof connector, comprising:

a connector housing in which a terminal connected to an end of an electric wire and a core wire part of the electric wire connected to the terminal are housed, the connector housing comprising:

a terminal housing part for housing the terminal;

a core-wire housing part continuously formed to the terminal housing part to house the core wire part of the electric wire; and a covered end insertion part into which a covered end of the electric wire is inserted, wherein the covered end insertion part is provided with a waterproof partition wall which keeps respective interiors of the core-wire housing part and the terminal housing part in a waterproof state, the terminal is free to move within the terminal housing part, and the core-wire housing part is provided, around the core wire part, with a hollow part which allows the core wire part to move freely within the core-wire housing part following movement of the terminal.

2. The waterproof connector of claim 1, wherein the terminal includes a counter-terminal connection box which allows a counter terminal to be inserted thereinto, and a core-wire connecting terminal plate to which the core wire part of the electric wire is connected.

3. The waterproof connector of claim 1, wherein the terminal housing part is formed with a counter-terminal insertion port;

the core-wire housing part is formed with a wire outlet port; and the wire outlet port is closed by a rear wall member.

* * * * *